US008950345B2

(12) United States Patent
Wang et al.

(10) Patent No.: US 8,950,345 B2
(45) Date of Patent: Feb. 10, 2015

(54) PULVERIZED COAL BURNER AND PULVERIZED COAL BOILER HAVING IT

(75) Inventors: Yupeng Wang, Yan Tai (CN); Hong Tang, Yan Tai (CN); Yuwang Miao, Yan Tai (CN); Wucheng Liu, Yan Tai (CN); Jingwu Zhang, Yan Tai (CN); Yubin Zhang, Yan Tai (CN); Shuweng Sun, Yan Tai (CN); Xingyuan Cui, Yan Tai (CN); Xixin Yang, Yan Tai (CN); Xinguang Wang, Yan Tai (CN); Zeru Gong, Yan Tai (CN); Lei Yi, Yan Tai (CN); Yingtao Wang, Yan Tai (CN)

(73) Assignee: Yantai Longyuan Power Technology Co., Ltd., Yan Tai (CN)

( * ) Notice: Subject to any disclaimer, the term of this patent is extended or adjusted under 35 U.S.C. 154(b) by 240 days.

(21) Appl. No.: 13/643,747

(22) PCT Filed: Apr. 26, 2011

(86) PCT No.: PCT/CN2011/073324

§ 371 (c)(1),
(2), (4) Date: Jan. 11, 2013

(87) PCT Pub. No.: WO2011/134388

PCT Pub. Date: Nov. 3, 2011

(65) Prior Publication Data

US 2013/0098278 A1 Apr. 25, 2013

(30) Foreign Application Priority Data

Apr. 27, 2010 (CN) ..... 2010 1 0167308

(51) Int. Cl.

| | |
|---|---|
| ***F23D 1/00*** | (2006.01) |
| ***F23K 3/02*** | (2006.01) |
| *F23C 7/00* | (2006.01) |

(52) U.S. Cl.

CPC . *F23D 1/00* (2013.01); *F23C 7/006* (2013.01); *F23D 2201/20* (2013.01)

USPC ..... 110/104 B; 110/261; 110/263; 110/265

(58) Field of Classification Search

CPC ... F23D 1/00; F23D 2201/00; F23D 2201/10; F23D 2201/20

USPC ..... 110/104 B, 261, 262, 263, 264, 265

See application file for complete search history.

(56) References Cited

U.S. PATENT DOCUMENTS 5,090,339 A * 2/1992 Okiura et al. ..... 110/263
5,685,242 A * 11/1997 Narato et al. ..... 110/262

(Continued)

FOREIGN PATENT DOCUMENTS

CN 1074993 A 8/1993
CN 1106909 A 8/1995

(Continued)

OTHER PUBLICATIONS

Chen, Z., et al., "Numerical Simulation of Gas-Particle Two Phase Flow Field for Swirl Burner," Journal of Mechanical Engineering 45(12):305-312, Dec. 2009.

(Continued)

*Primary Examiner* — David J Laux

(74) *Attorney, Agent, or Firm* — Christensen O'Connor Johnson Kindness PLLC

(57) ABSTRACT

A pulverized coal burner and a pulverized coal boiler. The coal burner comprises a primary air cylinder (111) and a pulverized coal concentration device (112). The coal concentration device (112) makes the concentration of the coal flow gradually decrease from inside to outside along the radial direction, with respect to an axis (100) of the primary air cylinder (111). The coal burner further comprises a coal separating cylinder (113) and a coal guiding cylinder (114) located downstream of the device (112), the rear end of the cylinder (113) is connected with the front end of the coal guiding cylinder (114). The outlet of the cylinder (114) has a conical expansion portion (1141). The coal burner further comprises a divergent nozzle (115) connected with the rear end of the primary air cylinder (111) and whose cross-sectional area gradually increases along the flow direction of the coal flow.

10 Claims, 3 Drawing Sheets

(56) References Cited

U.S. PATENT DOCUMENTS

| | | | | | |
|---|---|---|---|---|---|
| 5,937,770 | A | * | 8/1999 | Kobayashi et al. | 110/263 |
| 6,145,449 | A | * | 11/2000 | Kaneko et al. | 110/261 |
| 6,715,432 | B2 | * | 4/2004 | Tsumura et al. | 110/261 |
| 8,555,795 | B2 | * | 10/2013 | Cheng et al. | 110/104 B |
| 2009/0277364 | A1 | * | 11/2009 | Donais et al. | 110/263 |

FOREIGN PATENT DOCUMENTS

| | | | | | |
|---|---|---|---|---|---|
| CN | 2235065 | Y | | 9/1996 | |
| CN | 1155052 | A | | 7/1997 | |
| CN | 2387392 | Y | | 7/2000 | |
| CN | 1271826 | A | | 11/2000 | |
| CN | 1439842 | A | | 9/2003 | |
| CN | 201688400 | U | | 12/2010 | |
| JP | 60000205 | A | * | 1/1985 | F23D 1/02 |
| JP | 60030902 | A | * | 2/1985 | F23D 1/04 |
| JP | 02259309 | A | * | 10/1990 | F23D 1/02 |
| JP | 9159190 | A | | 6/1997 | |
| JP | 2000314508 | A | | 11/2000 | |

OTHER PUBLICATIONS

Chen, Z.-C., et al., "Study on Fuel Bias Combustion Swirl Technology of a 1025t/h Pulverized Coal Fired Boiler," Proceedings of the CSEE 24(4):189-194, Apr. 2004.

Lin, Z.-C., et al., "Experimental Research on Aerodynamic Field Characteristic of a Low NOx Swirl Burner," Journal of Power Engineering 28(3):355-360, Jun. 2008.

* cited by examiner

PULVERIZED COAL BURNER AND PULVERIZED COAL BOILER HAVING IT

CROSS-REFERENCE TO RELATED ART

This application claims the priority of the Patent Application No. 201010167308.7 in China entitled as "PULVERIZED COAL BURNER AND PULVERIZED COAL BOILER HAVING IT", filed on Apr. 27, 2010 to China Patent Office, which is hereby incorporated by reference in its entirety.

TECHNICAL FIELD

The present invention relates to a pulverized coal combustion technology, and in particular, to a pulverized coal burner, and also to a pulverized coal boiler having such pulverized coal burner.

DESCRIPTION OF THE RELATED ART $NO_x$ is a collective name of various nitrogen oxides, such as nitric oxide (NO) and nitrogen dioxide ($NO_2$), and is one of the main pollutants in the atmospheric pollutants. One major source of $NO_x$ is the combustion emissions of the pulverized coal and other fuels. In order to reduce the amount of the $NO_x$ emissions of the pulverized coal boiler, a number of pulverized coal burners were provided in prior art.

An invention patent application with Application No. CN03111101.7 discloses a center-feeding swirl burner, the result of a research on which was disclosed in a paper entitled as "Numerical Simulation of Gas-particle Two Phase Flow Field for Swirl Burner".

The research conclusions show that: the burner makes the pulverized coal flow of the primary air form a rich-to-lean distribution pattern from inside to outside along the radial direction of the burner through multiple separating rings so as to achieve the separation of the rich and lean pulverized coal flows; reuse the rotation effect of a secondary air to form a central recirculation zone at the center of the outlet of the burner, which will ignite the pulverized coal flow by entraining high temperature flue gas; the secondary air is fed stagedly to achieve air staged combustion.

FIG. 1 is a flow field distribution diagram of a pulverized coal burner with a central recirculation zone in prior art. As shown in FIG. 1, a central recirculation zone 11, a rich pulverized coal flow 14, a lean pulverized coal flow 13, and a secondary air flow 12 are respectively formed downstream of the outlet 16 of the pulverized coal burner 16 from the axis 10 of the burner outwardly along the radial direction. In the central recirculation zone 11 near the axis 10 of the burner, the high temperature flue gas entrained deep from the furnace body heats the pulverized coal flow so that the pulverized coal flow emitted from within the pulverized coal burner is gradually ignited from inside to outside and from the rich pulverized coal flow 14 to the lean pulverized coal flow 13, and burned; the secondary air flow 12 envelopes the outside of the ignited pulverized coal flow 13 and being fed stagedly, flowing into the burnout zone 15 together with the pulverized coal flow to burn mixedly. The rich pulverized coal flow 14 contains most of the pulverized coal in the pulverized coal flow, and will burn before flowing into the burnout zone 15; this burner enables the combustion of the rich pulverized coal flow 14 under oxygen-poor conditions, thereby inhibiting the generation of $NO_x$.

An invention patent application with Application No. CN00108132.2 discloses a novel swirl pulverized coal burner, a cold-state experimental study on a burner with the technical solutions of this patent publication was made in a paper entitled as "Experimental Research on Aerodynamic Field Characteristic of a Low $NO_x$ Swirl Burner", and the results show that this burner can form an annular recirculation zone between a central pulverized coal flow and a surrounding secondary air flow.

FIG. 2 is a flow field distribution diagram of a pulverized coal burner with an annular recirculation zone in prior art. As shown in FIG. 2, a lean pulverized coal flow 23, a rich pulverized coal flow 24, an annular recirculation zone 21, and a secondary air flow 22 are respectively formed downstream of the outlet 26 of the pulverized coal burner from the axis 20 of the burner outwardly along the radial direction; the pulverized coal flow concentrates in the vicinity of the axis 20 of the burner, presenting a distribution state with higher surrounding concentrations and lower central concentrations; the outer perimeter of the rich pulverized coal flow 24 is the annular recirculation zone 21 with certain negative pressure; the high temperature flue gas entrained by the annular recirculation zone 21 from within the furnace body directly contacts the rich pulverized coal flow 24 and heats it to above ignition temperature, so that the pulverized coal flow is gradually ignited from outside to inside and from rich to lean, burning and re-entering the burnout zone 25 to burn and burn out. Also, prior to entering the burnout zone 25, the pulverized coal burner enables the combustion of the rich pulverized coal flow 24 under oxygen-poor conditions, inhibiting the generation of $NO_x$.

In prior art, by means of a pulverized coal concentration device, and by the use of the inertial separation of the pulverized coal, a rich-lean separation of the pulverized coal flow can be achieved, and a rich and lean pulverized coal flow can be formed in the pulverized coal burner. But after emitted out of the outlet of the pulverized coal burner and prior to entering the burnout zone, the lean and rich pulverized coal flow are not completely separated and tend to mix again, damaging the effects of the rich-lean separation, and further limiting the inhibition of $NO_x$.

It is a technical problem currently faced by those skilled in the art how to better achieve the rich-lean separation of the pulverized coal flow in order to better inhibit the generation of $NO_x$ of the pulverized coal boiler.

SUMMARY OF THE INVENTION

To those above technical problems, the first object of the invention is to provide a pulverized coal burner, which can better improve the rich-lean separation effect and thereby improve the combustion effect of the pulverized coal flow, thereby better inhibiting the generation of $NO_x$ of the pulverized coal boiler.

On the basis of providing the above pulverized coal burner, the second object of the invention is to provide a pulverized coal boiler having said pulverized coal burner.

In order to achieve the above first object, said pulverized coal burner according to the invention comprises a primary air cylinder and a pulverized coal concentration device; the pulverized coal concentration device enables the concentration of the pulverized coal flow gradually increase from outside to inside along the radial direction with respect to the axis of the primary air cylinder, and differing from the prior art in that the pulverized coal burner further comprises a pulverized coal separating cylinder and a pulverized coal guiding cylinder located in the primary air cylinder and downstream of the pulverized coal concentration device, and the downstream end of the pulverized coal separating cylinder is connected with the upstream end of the pulverized coal guiding cylinder; the outlet of the pulverized guiding cylinder has a conical expansion portion; further comprising a divergent nozzle which is connected with the downstream end of the primary air cylinder and which has a cross-sectional area gradually increasing along the direction of the pulverized coal flow, the expansion angle of the divergent nozzle is greater than the expansion angle of the pulverized coal guiding cylinder.

Preferably, the cross-sectional area of the upstream end of the pulverized coal guiding cylinder is greater than the cross-sectional area of the downstream end of the pulverized coal separating cylinder.

Preferably, the upstream end of the pulverized coal separating cylinder has a divergent part which has a cross-sectional area gradually increasing along the direction of the pulverized coal flow.

Preferably, the flow cross-sectional area between the divergent part and the primary air cylinder decreases along the direction of the pulverized coal flow.

Preferably, the expansion angle of the outlet of the pulverized coal guiding cylinder is between 10° and 40°.

Preferably, the expansion angle of the divergent nozzle is between 50° and 90°.

Preferably, the pulverized coal burner further has a secondary air channel located outside of the primary air cylinder.

Preferably, the pulverized coal burner further comprises an ignition oil gun arranged in the secondary air channel or on the axis of the burner.

Preferably, the outlet of the secondary air channel has an expansion angle between 50° and 90°.

On the basis of providing the pulverized coal burner, in order to achieve the above second object, a pulverized coal boiler is also provided, which comprises a furnace body and any of the above pulverized coal boiler mounted on the furnace body.

In comparison with prior art, the pulverized coal burner according to the invention further comprises a pulverized coal separating cylinder and a pulverized coal guiding cylinder in the primary air cylinder, both of which are located downstream of the pulverized coal concentration device. The rich pulverized coal flow with predetermined concentration flows into the pulverized coal separating cylinder, and continuously flows downstream through the pulverized coal separating cylinder; meanwhile, the lean pulverized coal flow flows downstream outside the pulverized coal separating cylinder. This can forcibly separate the rich and lean pulverized coal flow in the pulverized coal burner to prevent their mixing before ignition. The outlet of the pulverized coal guiding cylinder has a conical expansion portion; further comprising a divergent nozzle which is connected with the downstream end of the primary air cylinder and which has a cross-sectional area gradually increasing along the direction of the pulverized coal flow, the expansion angle of the divergent nozzle is not smaller than the expansion angle of the pulverized guiding cylinder. Thus, after the rich and lean pulverized coal flow flows out of the pulverized coal separating cylinder, a predetermined distance will be created between the rich and lean pulverized coal flows, retaining the separation of the rich and lean pulverized coal flows; also, after the rich and lean pulverized coal flows are emitted out of the burner, the distance between the rich and lean pulverized coal flows will gradually increase, forming a negative pressure zone, entraining the high temperature flue gas in the burnout zone located downstream of the pulverized burner, making the high temperature flue gas flow into a zone between the rich and lean pulverized coal flows, and the rich and lean pulverized coal flows being ignited. The rich pulverized coal flow will burn under highly oxygen-poor conditions, and the Nitrogen element contained in the pulverized coal will be largely transferred to an intermediate product with reduction property; while the lean pulverized coal flow will burn in oxygen-rich conditions and produce nitrogen oxides; with the process of the combustion reaction, after the rich pulverized coal flow and the lean pulverized coal flow enter into the downstream burnout zone and are mixed with the secondary air, the intermediate product with reduction property produced by the combustion of the rich pulverized coal will react with the nitrogen oxides produced by the combustion of the lean pulverized coal and will produce nitrogen, thereby achieving the reduction of the nitrogen oxides, better inhibiting the generation of $NO_x$, and significantly reducing the amount of the production of the nitrogen oxides of the boiler.

In a further technical solution, the cross-sectional area of the upstream end of the pulverized guiding cylinder is greater than the cross-sectional area of the downstream end of the pulverized coal separating cylinder, a protruding expansion structure being formed between the pulverized coal guiding cylinder and the pulverized coal separating cylinder, and better facilitating the formation of the predetermined distance between the rich and lean pulverized coal flows.

In a further technical solution, the upstream end of the pulverized coal separating cylinder has a divergent part which has a cross-sectional area gradually increasing along the direction of the pulverized coal flow, thereby changing the flow rate of the rich pulverized coal flow, making a speed difference between the flow rates of the rich and lean pulverized coal flows, and facilitating the formation of the annular recirculation zone. Furthermore, the flow rate of the lean pulverized coal flow can be increased by gradually reducing the flow cross-sectional area between the divergent part and the primary air cylinder, to further increase the speed difference between the flow rates of the rich and lean pulverized coal flows.

In summary, the positive effects of the invention will be in that:

(1) By the use of the pulverized coal concentration device, the pulverized coal separating cylinder and the primary air cylinder, the pulverized coal flow can be separated into the rich and lean pulverized coal flows, emitting both flows into the furnace body in different directions, forming an annular recirculation zone between the rich and lean pulverized coal flows, achieving combustion under the rich-lean separation, thereby decreasing the amount of the production of $NO_x$.

(2) By the use of the negative pressure between the rich and lean pulverized coal flows, the high temperature flue gas can be entrained and the annular recirculation zone is formed, enabling the increase of the heating area of the pulverized coal flow, achieving the quick ignition of the pulverized coal, and ensuring the combustion stability and efficiency of the pulverized coal.

(3) At the outlet of the burner, most of the pulverized coal is surrounded by the high temperature flue gas in the annular recirculation zone and limited in the vicinity of the axis of the burner, the slagging of the water-cooling near the outlet of the burner being avoided, and the safety of the operation of the pulverized boiler being enhanced.

DETAILED DESCRIPTION OF THE PREFERRED EMBODIMENT

The preferred embodiments of the invention will be introduced in detail below in conjunction with the accompanying drawings. It should be noted that the cross-sectional area should be the flow cross-sectional area formed inside the space in the present application document.

Figure 1:
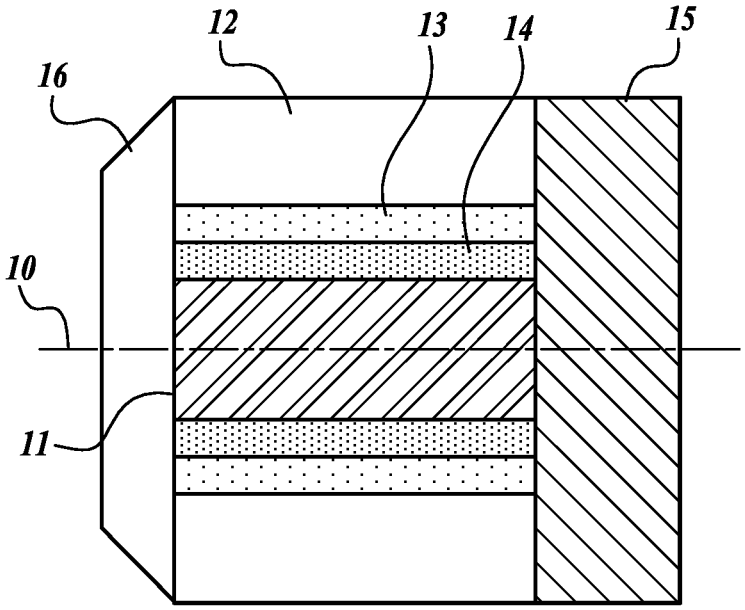
FIG. 1 is a flow field distribution diagram of a pulverized coal burner with a central recirculation zone in prior art.
Figure 2:
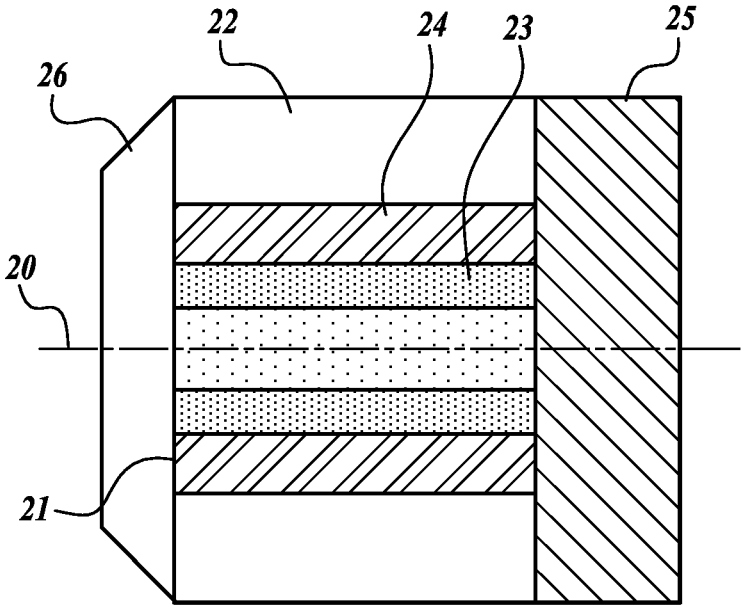
FIG. 2 is a flow field distribution diagram of a pulverized coal burner with an annular recirculation zone in prior art.
Figure 3:
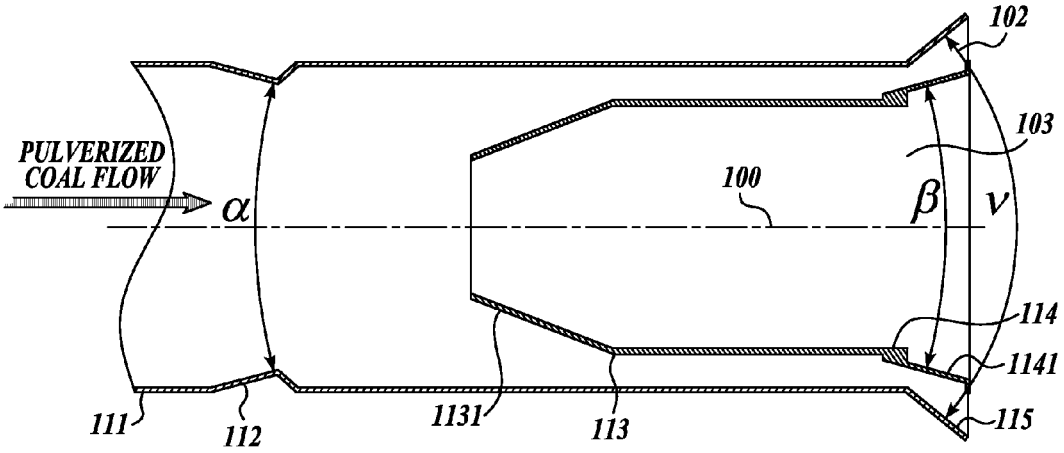
FIG. 3 shows a schematic structural view of a pulverized coal burner according to an embodiment of the invention.

FIG. 3 shows a schematic structural view of a pulverized coal burner according to the first embodiment of the invention. As shown in FIG. 3, this pulverized coal burner comprises a primary air cylinder 111, a pulverized coal concentration device 112, a pulverized coal separating cylinder 113, a pulverized coal flow guiding cylinder 114 and a divergent nozzle 115. In a pulverized coal boiler having this pulverized coal burner, generally there also is a secondary air channel for supplying secondary air to the pulverized coal boiler.

The pulverized coal concentration device 112 may be disposed in the primary air cylinder 111, and may also be arranged in an elbow of the burner. The functions of the pulverized coal concentration device 112 are of: making the rich-lean separation of the pulverized coal flow entering the pulverized coal burner, and making the pulverized coal in the pulverized coal flow concentrate in the vicinity of the axis 100 of the burner, thereby making the concentration of the pulverized coal flow gradually increase from outside to inside along the radial direction with respect to the axis 100 of the burner. In this embodiment, the pulverized coal concentration device 112 employs a structure with collapsed cross-section first and expansion cross-section second, comprising a necking portion and a flared portion connected to each other; the flow cross-sectional area of the necking portion will gradually decrease and the flow cross-sectional area of the flared portion will gradually increase along the direction of the pulverized coal flow. Wherein, the inner wall of the necking portion forms an expansion angle $\alpha$, which is the angle between two intersecting lines passing through the plane of the axis 100 of the burner and the inner wall. The necking portion may make the pulverized coal flow in the primary air gradually concentrate in the vicinity of the axis 100 of the burner. When the pulverized coal flow passes through the flared portion, the flow cross-sectional area will gradually increase, meanwhile the pulverized coal particles with relatively large inertia will still flow downstream near the axis 100 of the burner, while the pulverized coal particles with relatively small inertia will diffuse along the direction away from the axis 100 of the burner, i.e., diffusing towards the vicinity of the inner wall of the primary air cylinder 111. Hence, a distribution state in which the concentration of the pulverized coal flow will gradually increase from outside to inside along the radial direction of the burner will be formed downstream of the pulverized coal concentration device 112. After passing through the pulverized coal concentration device 112, most of the pulverized coal particles with relatively larger inertia and some of the primary air will distribute in a pre-determined radial direction range centering on the axis 100 of the burner, and forming the rich pulverized coal flow; and a few fine pulverized coal particles with relatively smaller inertia and the other primary air will surround the outer perimeter of the rich pulverized coal flow and form the lean pulverized coal flow.

The pulverized coal concentration device 112 is not limited to the above structures, and may also be the pulverized coal concentration device with other structures in prior art, such as a blinds-shaped pulverized coal concentration device disclosed by Patent Document CN2157400, a block-shaped pulverized coal concentration device disclosed by Patent Document CN1477330, and the like; it can also be a combination of a plurality of the pulverized coal concentration devices to better adjust the distribution of the concentration of the pulverized coal. According to the requirement of the adjustment of the concentration of the pulverized coal, the position of the pulverized coal concentration device 112 can be properly adjusted, and the pulverized coal concentration device 112 can be disposed in the pre-determined position in the pulverized coal channel.

The pulverized coal separating cylinder 113 is located in the predetermined position downstream of the pulverized coal concentration device 112, and there will be a predetermined distance between the pulverized coal separating cylinder 113 and the pulverized coal concentration device 112; preferably, the axis of the pulverized coal separating cylinder 113 is coincided with the axis 100 of the pulverized coal burner, making the rich pulverized coal flow entering the pulverized coal separating cylinder 113 further flow downstream and the lean pulverized coal flow entering the space between the pulverized coal separating cylinder 113 and the primary air cylinder 111 further flow downstream thereby forming the rich pulverized coal channel 103 within the pulverized coal separating cylinder 113 and the lean pulverized coal channel 102 between the pulverized coal separating cylinder 113 and the primary air cylinder 111; further forcibly separating the rich and lean pulverized coal flows and preventing the mixture of those flows before ignition.

The upstream end of the pulverized coal guiding cylinder 114 is connected with the downstream end of the pulverized coal separating cylinder 113, preferably, the axis of the pulverized coal separating cylinder 113 is coincided with the axis of the pulverized coal guiding cylinder 114, and the outlet of the pulverized coal guiding cylinder 114 has a conical expansion portion 1141; thus, when the lean pulverized coal flow passing through the expansion corner 1141, under the effect of the expansion corner 1141, the lean pulverized coal flow will depart from the axis 100 of the burner along the expansion corner 1141 to emit outwardly; while the rich pulverized coal flow passing through the pulverized coal guiding cylinder 114, it will keep the advancement direction along the axis 100 of the burner, further creating a predetermined jet angle between the rich and lean pulverized coal flows. The preferred technical solution will be to make the expansion angle $\theta$ of the expansion corner 1141 between 10 degree and 40 degree to form an appropriate jet angle.

To facilitating the emission of the lean pulverized coal flow so as to form the predetermined jet angle, the pulverized coal burner further comprises a divergent nozzle 115 which is connected with the downstream end of the primary air cylinder 111 and which has an inner diameter gradually increasing along the flow direction of the pulverized coal flow. The expansion angle $\gamma$ of the divergent nozzle 115 is greater than or equal to the expansion angle $\beta$ of the pulverized coal guiding cylinder 114, and the expansion angle $\gamma$ is preferably between 50 and 90.

Due to the predetermined jet angle formed between the rich and lean pulverized coal flows, an annual recirculation zone with predetermined negative pressure may be formed between the rich and lean pulverized coal flows.

Figure 4:
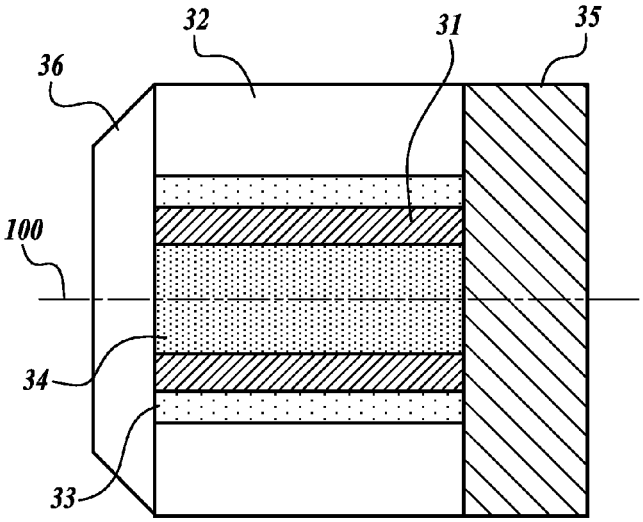
FIG. 4 shows the flow field distribution diagram of the pulverized coal burner according to the first embodiment.

FIG. 4 shows the flow filed distribution diagram of the pulverized coal burner according to the first embodiment. Downstream the outlet 26 of the pulverized coal burner, a rich pulverized coal flow 34, an annual recirculation zone 31, a lean pulverized coal flow 33 and a secondary air 32 will be sequentially formed in direction of the axis 100 of the burner from inside to outside; wherein the secondary air 32 will be supplied by the secondary air channel. The annular recirculation zone 31 between the rich pulverized coal flow 34 and the lean pulverized coal flow 33 has the predetermined negative pressure. Under the effect of the negative pressure of the annular recirculation zone 31, the high temperature flue gas from the downstream burnout zone 35 will be entrained into the annular recirculation zone 31; the high temperature flue gas entering the annular recirculation zone 31 separates and at the same time heats the rich pulverized coal flow 34 and the lean pulverized coal flow 33, and makes the separation combustion of the rich pulverized coal flow 34 and the lean pulverized coal flow 33.

As to the rich pulverized coal flow 34, due to its combustion under highly oxygen-poor conditions, the nitrogen element contained in the rich pulverized coal flow is largely transferred to an intermediate product with reduction property, while the lean pulverized coal flow 33 will be burned in oxygen-rich conditions and produce nitrogen oxides. With the processing of the combustion reaction, the rich pulverized coal flow 34, the lean pulverized coal flow 33 and the secondary air 32 will flow into the burnout zone 35 together. In the burnout zone 35, the intermediate product with reduction property produced by the combustion of the rich pulverized coal flow 34 will react with the nitrogen oxides produced by the combustion of the lean pulverized coal flow 23 to produce nitrogen, thereby achieving the reduction of the nitrogen oxide in the flame, and significantly reducing the total amount of the production of $NO_x$ of pulverized coal boiler. Due to Oxygen supplemented by the secondary air to the combustion, it will be ensured not to affect the combustion efficiency of the pulverized coal while reducing the amount of the production of $NO_x$.

In addition, with the pulverized coal burner according to the present embodiment, due to the rich pulverized coal flow 34 at the outlet of the burner being surrounded by the high temperature flue gas in the annular recirculation zone 31, and being limited to the vicinity of the axis 100 of the burner, the contact of the rich pulverized coal flow 34 with the water-cooled wall near the outlet of the burner will be avoided, avoiding the slagging occurrence of the water-cooled wall, and further enhancing the safety of the operation of the pulverized coal boiler. Meanwhile, the high temperature flue gas in the annular recirculation zone 31 will heat the rich pulverized coal flow 34 and the lean pulverized coal flow 33 simultaneously, the total heating area of the pulverized coal flow of the pulverized coal burner being equivalently doubled, and further making the pulverized coal easier to ignite, the combustion more stable and ensuring the combustion efficiency of the pulverized coal combustion.

In order to obtain a better annular recirculation zone 31 downstream of the outlet 26 of the pulverized coal burner, the following technical means will be further employed by the first embodiment.

Referring again to FIG. 3, the cross-sectional area of the upstream end of the pulverized coal flow guiding cylinder 114 is greater than the cross-sectional area of the downstream end of the pulverized coal separating cylinder 113, and a protruding expansion structure will be formed between the pulverized coal separating cylinder 113 and the pulverized coal guiding cylinder 114. The protruding expansion structure will better facilitate to form a predetermined distance between the rich and lean pulverized coal flows, and may retain the separation of the rich and lean pulverized coal flows.

The upstream end of the rich-lean pulverized coal separating cylinder 113 also has a divergent part 1131 whose cross-sectional area gradually increases along the direction of the pulverized coal flow; which makes the flow cross-sectional area of the corresponding divergent part 1131 of the rich pulverized coal channel 103 gradually increase, and make the rich pulverized coal flow speed gradually decrease. Meanwhile, in the corresponding portion of the divergent part 1131, the flow cross-sectional area of the primary air cylinder 111 keep unchanged, making the flow cross-sectional area of the lean pulverized coal channel 102 correspondingly gradually decrease and the speed of the lean pulverized coal flow increase. As a result, a predetermined flow speed difference will be created between the flow rates of the rich and lean pulverized coal flows.

Figure 5:
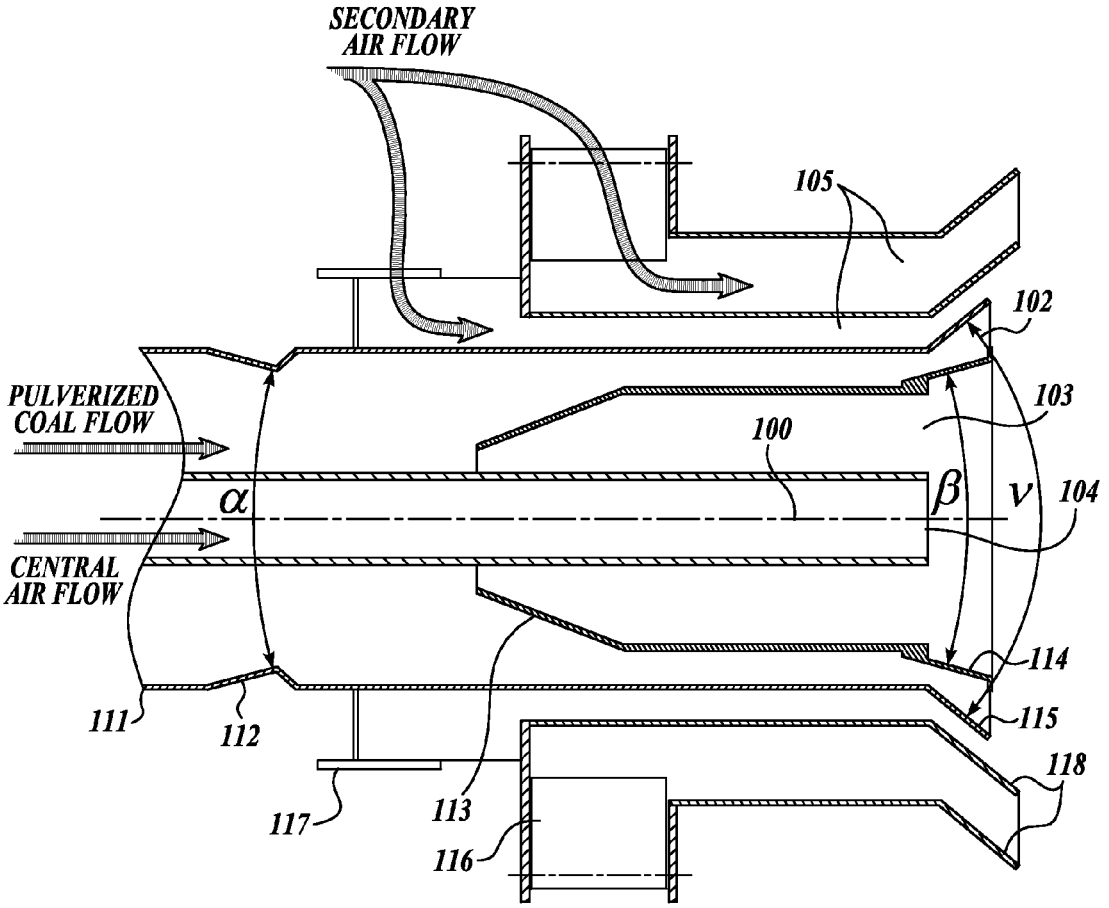
FIG. 5 shows the schematic structural view of the pulverized coal burner according to the second embodiment of the invention.

FIG. 5 shows a schematic structural view of a pulverized coal burner according to the second embodiment of the present invention. A secondary air channel 105 is arranged outside of the primary air cylinder 111 of the pulverized coal burner; the secondary air channel 105 is divided at least to two layers, each layer having a respective outlet; preferably, there will be an expansion corner 118 at the outlet, and along radial direction of the burner from inside to outside, the expansion angle of the multiple outlets gradually increase, preferably, the expansion angle 118 is between 50 degree and 90 degree; the inlet of the secondary air channel 105 is provided with an adjustable vent 117 to adjust the air volume entering the secondary air channel 105; in order to enhance the mixing of the secondary air and the pulverized coal, lobes 116 may be disposed in the channel of a layer of the secondary air, and rotate the secondary air flow.

In order to meet the ignition requirement of the pulverized coal boiler, an oil gun air channel 104 is disposed at the axial position of the burner to arrange an ignition oil gun and provide a central air flow to the oil gun. Further, this oil gun air channel 104 may also be arranged in the secondary air channel 105, and meet the ignition requirement of the pulverized coal boiler as well.

On the basis of the pulverized coal burner, the invention also provides a pulverized boiler, which comprises a furnace body and any of the above pulverized coal burners mounted on the furnace body. The pulverized coal boiler may reduce the formation amount of $NO_x$.

While the above description is only preferred embodiments of the present invention, it should be noted that various improvements and modifications can be made by those ordinary skilled persons in the art without departing from the principles of the invention, these improvements and modifications should also be considered as the protection scope of the present invention.

What is claimed is:

1. A pulverized coal burner, comprising a primary air cylinder and a pulverized coal concentration device; wherein the pulverized coal concentration device enables the concentration of the pulverized coal flow to gradually increase from outside to inside along the radial direction, with respect to an axis of the primary air cylinder, characterized in that it further comprises a pulverized coal separating cylinder and a pulverized coal guiding cylinder located in the primary air cylinder and downstream of the pulverized coal concentration device, wherein the downstream end of the pulverized coal separating cylinder is connected with the upstream end of the pulverized coal guiding cylinder, and an outlet of the pulverized coal guiding cylinder has a conical expansion portion; and it further comprises a divergent nozzle which is connected with the downstream end of the primary air cylinder and which has a cross-sectional area gradually increasing along the flow direction of the pulverized coal flow, and the expansion angle of the divergent nozzle is not smaller than the expansion angle of the pulverized coal guiding cylinder.

2. The pulverized coal burner according to claim 1, characterized in that the cross-sectional area of the upstream end of the pulverized coal guiding cylinder is greater than the cross-sectional area of the downstream end of the pulverized coal separating cylinder.

3. The pulverized coal burner according to claim 1, characterized in that the upstream end of the pulverized coal separating cylinder has a divergent part which has a cross-sectional area gradually increasing along the flow direction of the pulverized coal flow.

4. The pulverized coal burner according to claim 3, characterized in that the flow cross-sectional area between the divergent part and the primary air cylinder gradually decreases along the flow direction of the pulverized coal flow.

5. The pulverized coal burner according to claim 1, characterized in that the expansion angle of the outlet of the pulverized coal guiding cylinder is between 10° and 40°.

6. The pulverized coal burner according to claim 5, characterized in that the expansion angle of the divergent nozzle is between 50° and 90°.

7. The pulverized coal burner according to claim 1, characterized in that it further comprises a secondary air channel, which is located outside of the primary air cylinder.

8. The pulverized coal burner according to claim 7, characterized in that it further comprises an ignition oil gun arranged in the secondary air channel or on the axis of the burner.

9. The pulverized coal burner according to claim 8, characterized in that an outlet of the secondary air channel has an expansion angle between 50° and 90°.

10. A pulverized coal boiler, comprising a furnace body, characterized in that it further comprises a pulverized coal burner mounted on the furnace body, wherein the pulverized coal burner comprises a primary air cylinder and a pulverized coal concentration device; wherein the pulverized coal concentration device enables the concentration of the pulverized coal flow gradually increase from outside to inside along the radial direction, with respect to an axis of the primary air cylinder, characterized in that it further comprises a pulverized coal separating cylinder and a pulverized coal guiding cylinder located in the primary air cylinder and downstream of the pulverized coal concentration device, wherein the downstream end of the pulverized coal separating cylinder is connected with the upstream end of the pulverized coal guiding cylinder, and an outlet of the pulverized coal guiding cylinder has a conical expansion portion; and it further comprises a divergent nozzle which is connected with the downstream end of the primary air cylinder and which has a cross-sectional area gradually increasing along the flow direction of the pulverized coal flow, and the expansion angle of the divergent nozzle is not smaller than the expansion angle of the pulverized coal guiding cylinder.

* * * * *